US009261811B2

(12) United States Patent
Hagiwara et al.

(10) Patent No.: US 9,261,811 B2
(45) Date of Patent: Feb. 16, 2016

(54) DEVELOPER CARRYING MEMBER, DEVELOPING ASSEMBLY, PROCESS CARTRIDGE, AND IMAGE FORMING APPARATUS

(71) Applicant: CANON KABUSHIKI KAISHA, Tokyo (JP)

(72) Inventors: Kazunari Hagiwara, Yokohama (JP); Tatsuaki Orihara, Tokyo (JP); Shuhei Tokiwa, Tokyo (JP); Yasuyuki Matsumoto, Kawasaki (JP); Naoki Fuei, Fujisawa (JP); Makoto Fukatsu, Santou (JP); Yoshikuni Ito, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/532,402

(22) Filed: Nov. 4, 2014

(65) Prior Publication Data

US 2015/0132031 A1 May 14, 2015

(30) Foreign Application Priority Data

Nov. 13, 2013 (JP) ..... 2013-235293

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0808; G03G 15/0818
See application file for complete search history.

(56) References Cited

U.S. PATENT DOCUMENTS

| | | | | |
|---|---|---|---|---|
| 5,084,369 | A | 1/1992 | Tanaka et al. | |
| 5,214,208 | A | 5/1993 | Tanaka et al. | |
| 2002/0114649 | A1 * | 8/2002 | Ohuchi | 399/286 |
| 2009/0010684 | A1 * | 1/2009 | Satoh | G03G 15/0818 399/286 |
| 2009/0233776 | A1 | 9/2009 | Mizumoto et al. | |
| 2010/0158564 | A1 * | 6/2010 | Nakamura et al. | 399/111 |
| 2013/0295330 | A1 * | 11/2013 | Kodama | G03G 15/02 428/147 |

FOREIGN PATENT DOCUMENTS

| | | | | |
|---|---|---|---|---|
| EP | 1 531 369 | A1 | 5/2005 | |
| EP | 2 348 367 | A1 | 7/2011 | |
| JP | 7-31454 | B2 | 4/1995 | |
| WO | WO 2008136487 | A1 * | 11/2008 | G03G 15/0818 |

OTHER PUBLICATIONS

European Search Report dated Mar. 23, 2015 in European Application No. 14192769.9.

U.S. Appl. No. 14/532,487, filed Nov. 4, 2014. Inventor: Hagiwara, et al.

* cited by examiner

*Primary Examiner* — Francis Gray

(74) *Attorney, Agent, or Firm* — Fitzpatrick, Cella, Harper and Scinto

(57) ABSTRACT

A developing roller that is capable of carrying toner on a surface thereof, and that supplies the toner carried on the surface to a surface of a photosensitive drum when a voltage is applied thereto, includes: a rubber layer; and a surface layer that covers the rubber layer, contains alumina, and has a higher volume resistivity than the rubber layer.

10 Claims, 9 Drawing Sheets

DEVELOPER CARRYING MEMBER, DEVELOPING ASSEMBLY, PROCESS CARTRIDGE, AND IMAGE FORMING APPARATUS

BACKGROUND OF THE INVENTION

1. Field of the Invention

The present invention relates to a developer carrying member, a developing assembly, a process cartridge, and an image forming apparatus.

2. Description of the Related Art

A conventional image forming apparatus using an electrophotographic system includes a photosensitive drum serving as an image bearing member and a developing roller serving as a developer carrying member. In this image forming apparatus, a development process for visualizing a latent image formed on the photosensitive drum is performed by transferring toner serving as a developer carried on the developing roller to the latent image.

As a conventional developing system using a single-component toner, a contact developing system using a developing roller having an elastic layer has been proposed. In a region (referred to hereafter as a non-image portion) of the photosensitive drum where the toner is not to be transferred, within a contact region (referred to hereafter as a developing nip portion) where the photosensitive drum contacts the developing roller, a voltage is applied so that the toner receives a force traveling from the photosensitive drum toward the developing roller.

Here, non-image portion contamination (referred to hereafter as fog) may occur when the toner is transferred to the non-image portion of the photosensitive drum, where the toner is not intended to be transferred. Fog is generated when a charge of the toner decays or a polarity of the toner reverses in the developing nip portion where the photosensitive drum contacts the developing roller. It is known that a charge-providing performance in relation to the toner deteriorates particularly in a high humidity environment. When the charge-providing performance in relation to the toner deteriorates, the charge of the toner decays, leading to an increase in the amount of fog.

Japanese Patent Publication No. H7-31454 proposes setting a volume resistance of the developing roller at or above a predetermined value in order to suppress the occurrence of fog in which toner is transferred onto a non-image portion of a photosensitive drum.

SUMMARY OF THE INVENTION

However, when the volume resistance of the developing roller is simply increased, a development performance deteriorates due to a reduction in density and so on.

Hence, in consideration of the problems described above, an object of the present invention is to suppress the occurrence of fog while maintaining a favorable development performance.

To achieve this object, a developer carrying member according to the present invention that is capable of carrying a developer on a surface thereof, and that supplies the developer carried on the surface to a surface of an image bearing member when a voltage is applied thereto, comprising:

an elastic layer; and a surface layer that covers the elastic layer, contains alumina, and has a higher volume resistivity than the elastic layer.

Further, a developing assembly according to the present invention comprising:

a developer container housing a developer; and the developer carrying member.

Further, a process cartridge according to the present invention that can be attached to a main body of an image forming apparatus detachably in order to perform an image formation process, comprising:

an image bearing member capable of bearing a developer image; and the developer carrying member, which forms the developer image by developing an electrostatic latent image on the image bearing member.

Further, an image forming apparatus according to the present invention comprising:

an image bearing member capable of bearing a developer image;

the developer carrying member, which forms the developer image by developing an electrostatic latent image on the image bearing member; and applying means for applying a voltage to the developer carrying member.

According to the present invention, the occurrence of fog can be suppressed while maintaining a favorable development performance.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

First Embodiment

Figure 1:
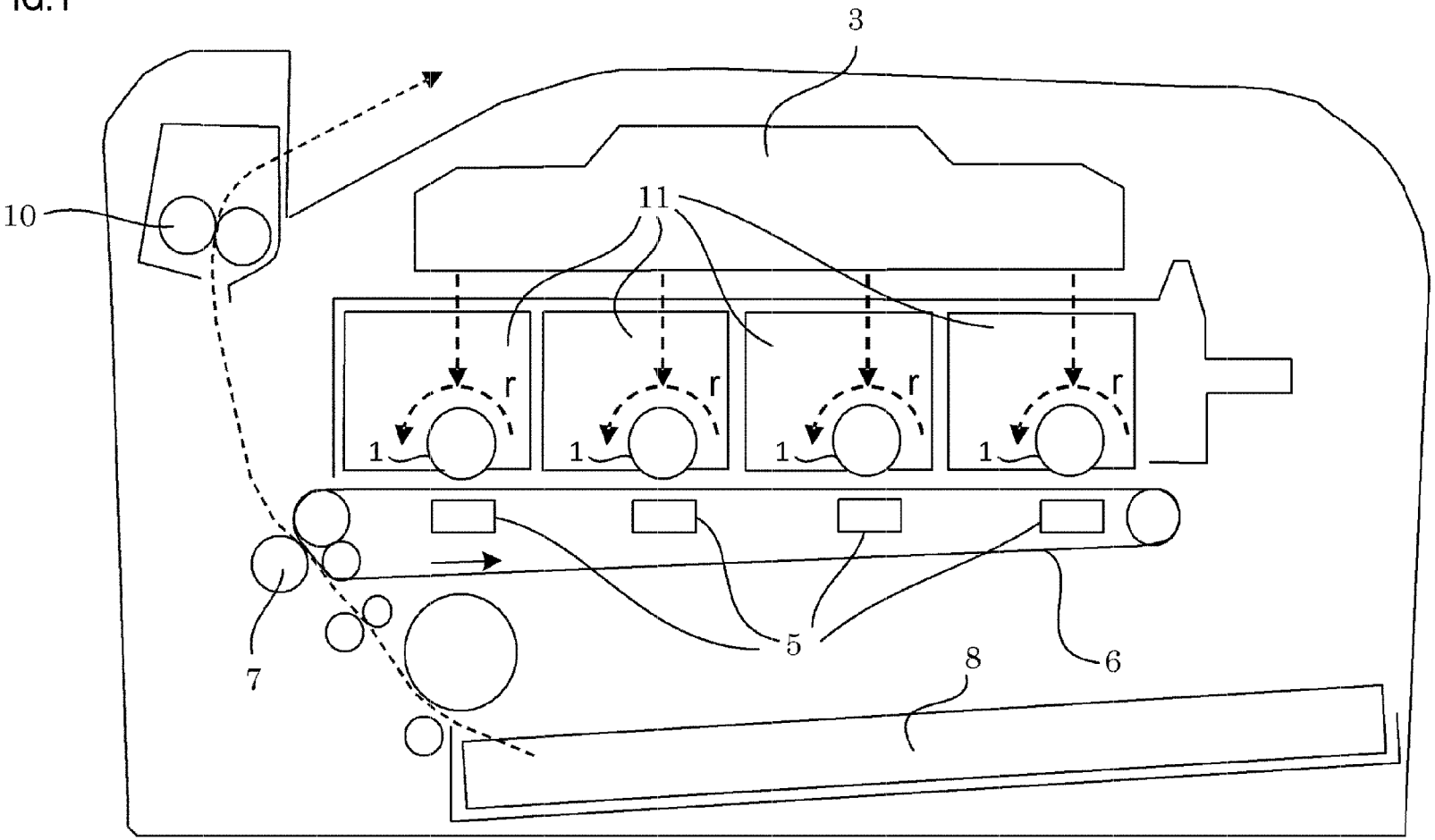
FIG. 1 is a schematic sectional view showing a configuration of an image forming apparatus according to an embodiment.
Figure 2:
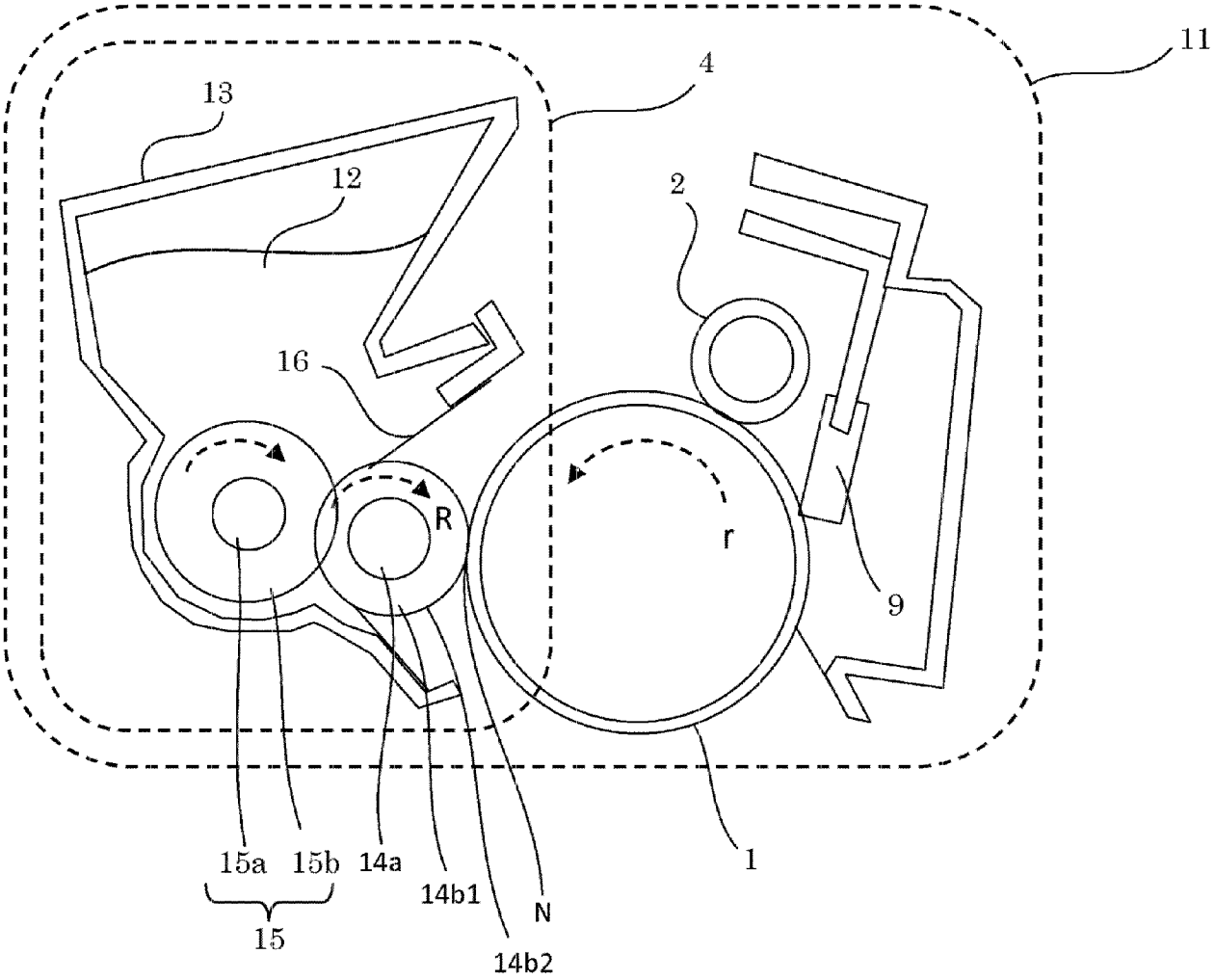
FIG. 2 is a schematic sectional view showing a configuration of a cartridge according to a first embodiment.

Referring to FIGS. 1 and 2, a first embodiment will be described. FIG. 1 is a schematic sectional view showing a configuration of an image forming apparatus according to a first embodiment and a second embodiment. FIG. 2 is schematic sectional views showing a configuration of a cartridge according to the first embodiment.

As shown in FIG. 1, the image forming apparatus includes a laser optical apparatus 3 serving as an exposure apparatus, a primary transfer apparatus 5, an intermediate transfer member 6, a secondary transfer apparatus 7, and a fixing apparatus 10. The image forming apparatus also includes a process cartridge (referred to hereafter simply as a cartridge) 11 that performs an image forming process and can be attached to and detached from an apparatus main body. As shown in FIG. 2, the cartridge 11 includes a photosensitive drum 1 serving as an image bearing member capable of bearing a latent image, a charging roller 2 serving as a charging apparatus, a developing assembly 4, and a cleaning blade 9.

The photosensitive drum 1 is provided to be capable of rotating in a direction of an arrow r in FIG. 2, and a surface of the photosensitive drum 1 is charged to a uniform surface potential Vd by the charging roller 2 (a charging process). By emitting a laser beam from the laser optical apparatus 3, an electrostatic latent image is formed on the surface of the photosensitive drum 1 (an exposure process). Further, by supplying toner from the developing assembly 4 as a developer, the electrostatic latent image is visualized as a toner image serving as a developer image (a development process).

The visualized toner image on the photosensitive drum 1 (on the image bearing member) is transferred onto the intermediate transfer member 6 by the primary transfer apparatus 5, and then transferred onto a sheet 8 serving as a recording medium by the secondary transfer apparatus 7 (a transfer process). Here, untransferred toner that remains on the photosensitive drum 1 having not been transferred in the transfer process is scraped away by the cleaning blade 9 (a cleaning process). After the surface of the photosensitive drum 1 has been cleaned, the charging process, exposure process, development process, and transfer process described above are repeated. Meanwhile, the toner image transferred onto the sheet 8 is fixed by the fixing apparatus 10, whereupon the sheet 8 is discharged to the exterior of the image forming apparatus.

In the first embodiment, the apparatus main body is provided with four attachment portions to which the cartridge 11 is attached. Cartridges 11 filled respectively with yellow, magenta, cyan, and black toner are attached in order from an upstream side of a movement direction of the intermediate transfer member 6, and a color image is formed by transferring the toner in the respective colors in sequence onto the intermediate transfer member 6.

The photosensitive drum 1 is formed by laminating an organic photoreceptor coated sequentially with a positive charge injection prevention layer, a charge generation layer, and a charge transport layer onto an aluminum (Al) cylinder serving as a conductive substrate. Arylate is used as the charge transfer layer of the photosensitive drum 1, and a film thickness of the charge transport layer is regulated to 23 μm. The charge transport layer is formed by dissolving a charge transporting material into a solvent together with a binder. Examples of organic charge transporting materials include acryl resin, styrene resin, polyester, polycarbonate resin, polyarylate, polysulphone, polyphenylene oxide, epoxy resin, polyurethane resin, alkyd resin, and unsaturated resin. These charge transporting materials may be used singly or in combinations of two or more.

The charging roller 2 is formed by providing a semiconductive rubber layer on a core metal serving as a conductive support member. The charging roller 2 exhibits a resistance of approximately $10^5\Omega$ when a voltage of 200 V is applied to the conductive photosensitive drum 1.

As shown in FIG. 2, the developing assembly 4 includes a developer container 13, a developing roller 14 serving as a developer carrying member capable of carrying toner, a supply roller 15, and a regulating blade 16 serving as a regulating member. Toner 12 serving as a developer is housed in the developer container 13. The developing roller 14 is provided to be capable of rotating in a direction of an arrow R in FIG. 2. The supply roller 15 supplies the toner 12 to the developing roller 14. The regulating blade 16 regulates the toner on the developing roller 14 (on the developer carrying member). Further, the supply roller 15 is provided to be capable of rotating while contacting the developing roller 14, and one end of the regulating blade 16 contacts the developing roller 14.

The supply roller 15 is configured by providing a urethane foam layer **15*b* around a core metal electrode 15*a* that has an outer diameter of ϕ5.5 mm and serves as a conductive support member. An overall outer diameter of the supply roller 15, including the urethane foam layer 15*b*, is ϕ13 mm. A penetration level of the supply roller 15 relative to the developing roller 14 is 1.2 mm. In a contact region between the supply roller 15 and the developing roller 14, the supply roller 15 and the developing roller 14 rotate in directions having mutually opposite direction speeds. A powder pressure of the toner 12 existing on the periphery of the urethane foam layer 15*b* acts on the urethane foam layer 15*b*, and when the supply roller 15 rotates, the toner 12 is taken into the urethane foam layer 15*b*. The supply roller 15 containing the toner 12 supplies the toner 12 to the developing roller 14 in the contact region with the developing roller 14, and by rubbing against the toner 12, applies a preliminary triboelectric charging charge to the toner 12. Meanwhile, in a contact region (referred to hereafter as a developing nip portion) N between the photosensitive drum 1 and the developing roller 14, the supply roller 15 also serves to peel away the toner that remains on the developing roller 14 having not been supplied to the photosensitive drum 1**.

As the developing roller 14 rotates, the toner 12 supplied to the developing roller 14 from the supply roller 15 reaches the regulating blade 16, where the toner 12 is regulated to a desired charge amount and a desired layer thickness. The regulating blade 16 is a stainless steel (SUS) blade having a thickness of 80 μm, and is disposed in a reverse orientation (in a counter direction) to the rotation of the developing roller 14. Further, a voltage is applied to the regulating blade 16 so that a potential difference of 200 V is generated relative to the developing roller 14. This potential difference is required to stabilize coating of the toner 12. A toner layer (a developer layer) formed on the developing roller 14 by the regulating blade 16 is conveyed to the developing nip portion N, and subjected to reversal development in the developing nip portion N.

The penetration level of the developing roller 14 relative to the photosensitive drum 1 is set at 40 μm by a roller, not shown in the drawings, provided on an end portion of the developing roller 14. The surface of the developing roller 14 deforms when pressed against the photosensitive drum 1 to form the developing nip portion N, whereby development can be performed in a stable contact state. Further, in the developing nip portion N where the developing roller 14 contacts the photosensitive drum 1, the developing roller 14 rotates in an identical direction (the R direction) to the rotation direction (the r direction) of the photosensitive drum 1 at a circumferential speed ratio of 117% relative to the photosensitive drum 1. In other words, the photosensitive drum 1 is provided to be capable of rotating such that a surface movement direction thereof in the developing nip portion N is identical to the developing roller 14, while the developing roller 14 rotates at a higher rotation speed than the photosensitive drum 1. This circumferential speed difference is provided in order to apply a shearing force to the toner, thereby reducing a substantive attachment force thereof so that controllability by means of an electric field is improved.

Specific voltages constituting the first embodiment will now be described. By applying −1050 V to the charging roller 2, the surface of the photosensitive drum 1 is charged uniformly to −500 V, and as a result, a dark potential Vd is formed. A potential (a light potential Vl) of an image portion in which an image is formed is adjusted to −100 V by the laser optical apparatus 3. By applying a voltage of −300 V to the developing roller 14 at this time, the negative polarity toner is transferred to the image portion (the region of the light potential Vl), whereby reversal development is performed. Further, |Vd−Vdc| will be referred to as Vback, and Vback is set as 200 V. Incidentally, the image forming apparatus according to this embodiment has a power supply serving as applying means for applying a voltage to the developing roller 14.

In the first embodiment, single component, non-magnetic toner is used as the toner 12 serving as the developer. The toner 12 is adjusted so as to contain a binder resin and a charge control agent, and manufactured to have negative polarity by adding a fluidizing agent or the like thereto as an external additive. Furthermore, the toner 12 is manufactured using a polymerization method, and regulated to an average particle size of approximately 5 μm.

Further, an amount of toner charged into the developer container 13 of the developing assembly 4 is set at an amount enabling printing of 3000 sheets of a converted image having an image ratio of 5%. An image formed by repeatedly printing one dot line and leaving nineteen dot lines unprinted may be cited as a specific example of horizontal lines having an image ratio of 5%.

During the image forming process, the photosensitive drum 1 is driven to rotate by the image forming apparatus at a rotation speed of 120 mm/sec in the direction of an arrow r in the drawings. Further, the image forming apparatus according to this embodiment includes a low speed mode in which the process speed is set at 60 mm/sec, which is lower than the normal speed, in order to secure an amount of heat required to perform fixing during passage of a thick recording sheet (a thick sheet). Note that in this embodiment, operations are performed in only two process modes, but depending on the thickness of the recording sheet and so on, a plurality of process modes may be provided so that control corresponding to the respective process modes can be executed.

Second Embodiment

Figure 3:
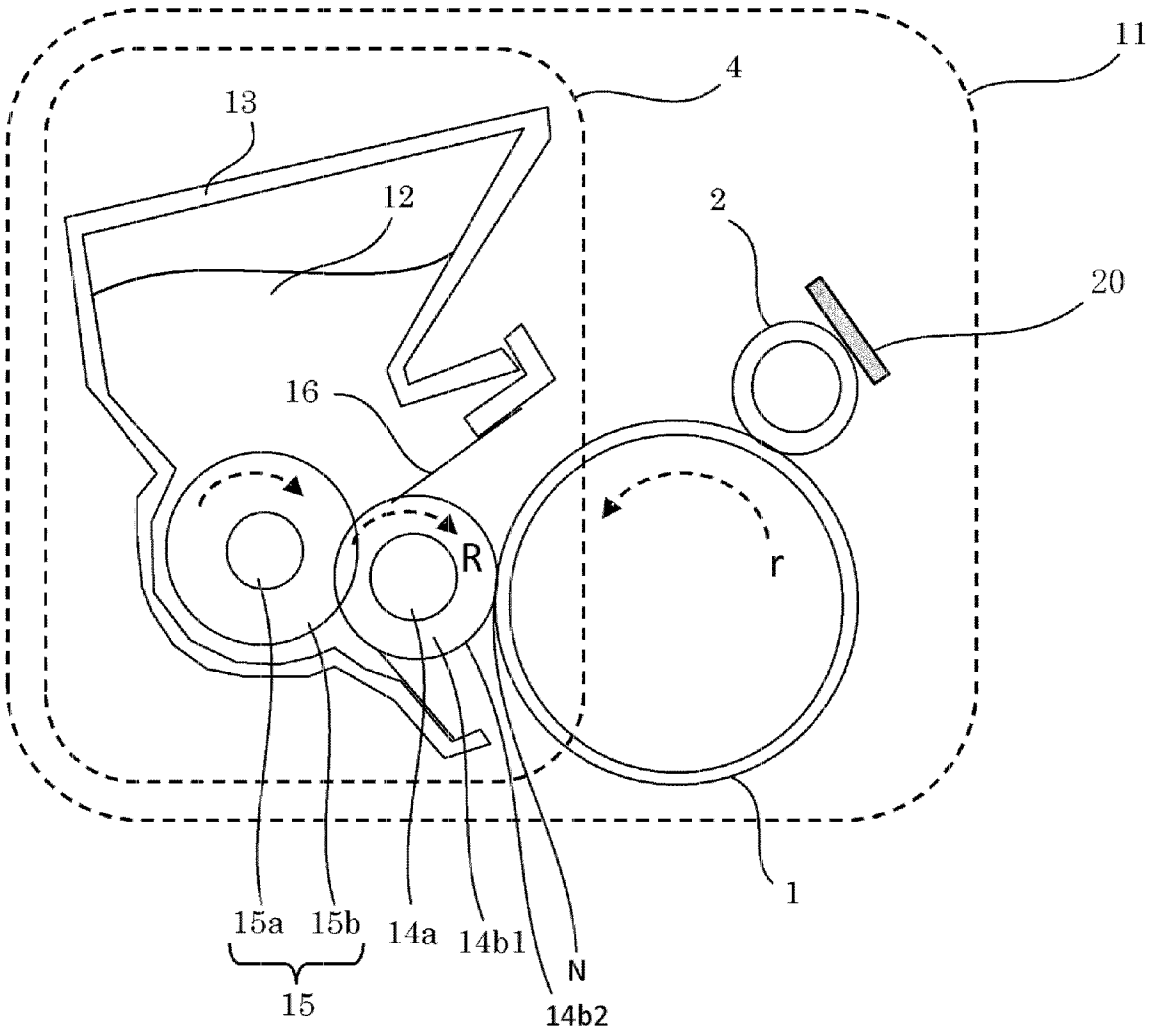
FIG. 3 is a schematic sectional view showing a configuration of a cartridge according to a second embodiment.

Next, referring to FIG. 3, a second embodiment will be described. FIG. 3 is a schematic sectional view showing a configuration of a cartridge according to the second embodiment. An image forming apparatus according to the second embodiment is a laser printer that uses a transfer type electrophotographic process and includes a toner recycling process (a cleanerless system). Duplicate description of points that are identical to the image forming apparatus of the first embodiment, described above, has been omitted, and only differences will be described below. The main difference with the first embodiment is that the cleaning blade 9 that cleans the photosensitive drum 1 is omitted, and the untransferred toner is recycled. The untransferred toner is circulated so as not to adversely affect the other processes such as charging, and collected in the developing assembly 4. More specifically, the configuration of the first embodiment is modified as follows.

As regards charging, a similar charging roller to the charging roller 2 of the first embodiment is used, but a charging roller contact member 20 is provided with the aim of preventing the charging roller 2 from being soiled by toner. A 100 μm polyimide film is used as the charging roller contact member 20, and the polyimide film contacts the charging roller 2 at a linear pressure of no more than 10 (N/m). Polyimide is used because it possesses a triboelectric charging characteristic for applying a negative charge to the toner. Even when the charging roller 2 is soiled by toner having a reverse polarity (positive polarity) to the charging polarity thereof, the charging roller contact member 20 switches the charge of the toner from positive to negative so that the charging roller 2 can expel the toner quickly and the expelled toner can be collected in the developing assembly 4.

Further, to improve the toner collecting performance of the developing assembly 4, an absolute value of the dark potential Vd and the value of Vback were set to be large. More specifically, the surface of the photosensitive drum 1 is set at a uniform surface potential Vd of −800 V by setting the voltage applied to the charging roller 2 at −1350 V. Furthermore, Vback is set at 500 V by setting a developing bias at −300 V.

First Example

Figure 4:
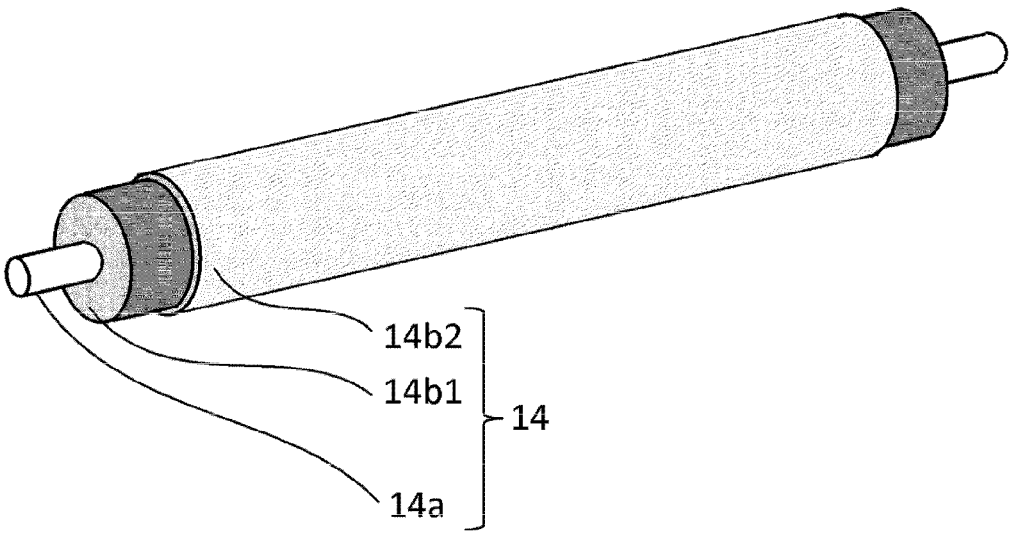
FIG. 4 is a perspective view showing a developing roller according to a first example.

Next, using FIG. 4, a developing roller 14 according to a first example will be described. FIG. 4 is a perspective view showing the developing roller according to the first example. The developing roller used in this example, shown in FIG. 4, was manufactured as follows.

A conductive rubber layer **14*b*1 containing a conductive agent was provided on a periphery of a core metal electrode 14*a* having an outer diameter of ϕ6 mm and serving as a conductive support member, whereby an outer diameter of ϕ11.5 mm was obtained. Here, any typical type of rubber, such as silicon rubber, urethane rubber, EPDM (ethylene propylene copolymer), hydrin rubber, or a mixture thereof, may be used as the material of the rubber layer 14*b*1**.

In the first example, the rubber layer **14*b*1 was formed from 2.5 mm of silicon rubber and a 10 μm urethane layer. A desired resistance value can be obtained by dispersing carbon particles, metal particles, ion conduction particles, or the like through the rubber layer 14*b*1 as the conductive agent, and in the first example, carbon particles were used. Further, the rubber layer 14*b*1 was manufactured to a have a desired hardness by adjusting the amount of silicon rubber and an amount of silica serving as a filler in order to adjust the overall hardness of the developing roller 14**.

Next, a 1.5 μm alumina surface layer (also referred to simply as a surface layer hereafter) **14*b*2 was formed by preparing a colloidal alumina solution and dipping the rubber layer 14*b*1** in the colloidal alumina solution, with the result that a conductive elastic layer was formed. The colloidal alumina solution used here was prepared by stirring and mixing together alumina sol liquid 520 (average particle diameter 20 nm, Boehmite), manufactured by Nissan Chemical Industries Ltd., and ethanol to a volume ratio of 1:4.

Further, in the first example, a surface of the rubber layer **14*b*1 was subjected to UV irradiation before being dipped in order to improve a coating performance and an adhesiveness of the colloidal alumina solution. After forming the alumina surface layer 14*b*2, the developing roller 14** was dried for fifteen minutes at 140° C.

The alumina according to this example is an aluminum oxide such as α alumina or γ alumina, an aluminum oxide hydrate such as Boehmite or pseudo-Boehmite, aluminum hydrate, or an aluminum compound, to be described below, obtained by subjecting aluminum alkoxide to hydrolysis and a condensation reaction. In consideration of the stability of the colloidal alumina solution, Boehmite or pseudo-Boehmite is preferably used, and in consideration of a formation stability of the surface layer, an aluminum oxide compound obtained by subjecting aluminum alkoxide to hydrolysis and a condensation reaction, to be described below, is preferably used.

Further, in the present invention, an overall resistance (a volume resistance) of the developing roller 14 is preferably greater than $2\times10^4\Omega$ and smaller than $5\times10^6\Omega$. At or below $2\times10^4\Omega$, a current flowing through the rubber layer 14*b*1 serving as the elastic layer increases, leading to an increase in a required current amount. Furthermore, at or above $5\times10^6\Omega$, a current that flows during development is likely to be obstructed. In the developing roller 14 according to the first example, the overall resistance was set at $5\times10^5\Omega$.

<<Method of Measuring Volume Resistance of Developing Roller>>

Figure 5:
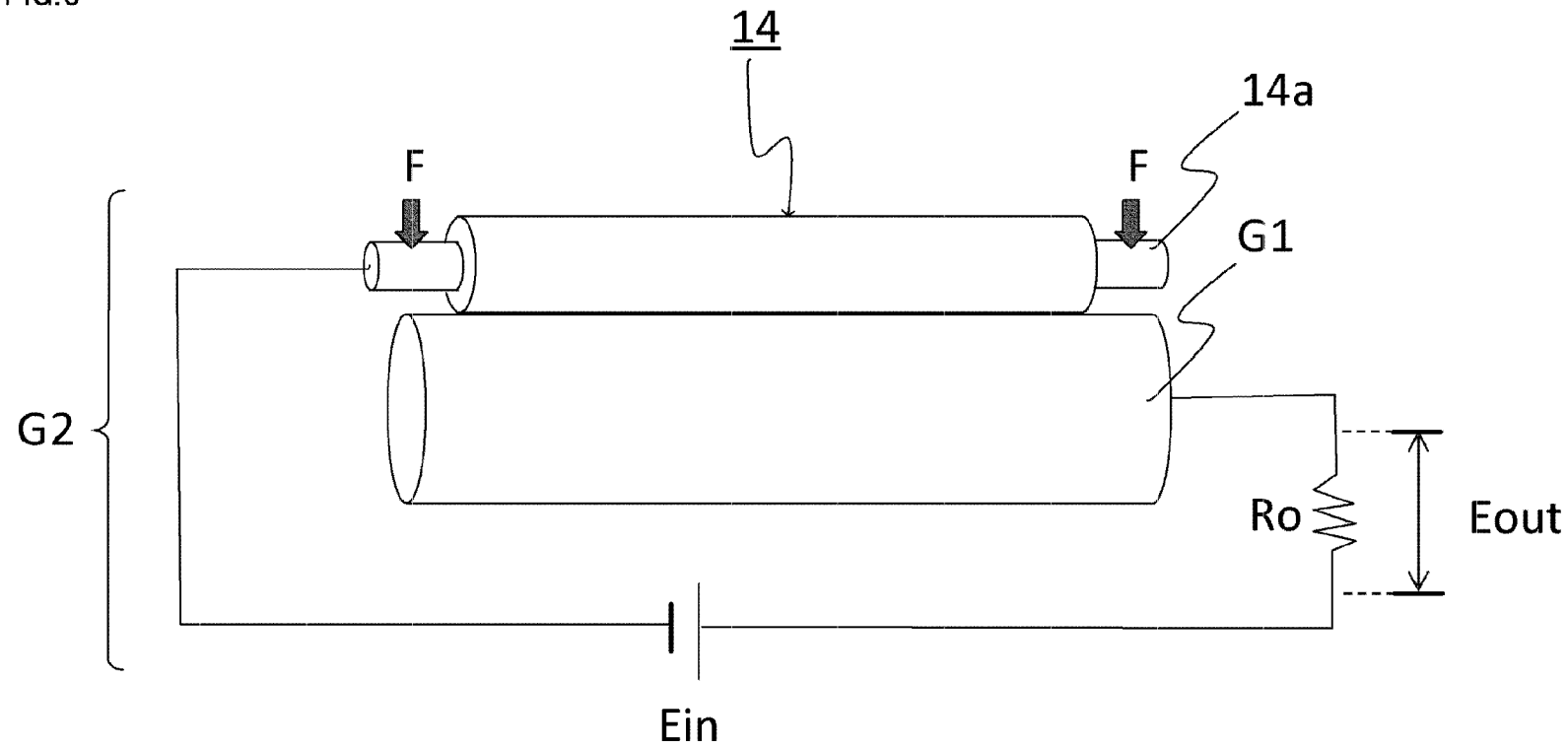
FIG. 5 is a view illustrating measurement of a volume resistance of the developing roller.

Next, using FIG. 5, a method of measuring the overall volume resistance (also referred to simply as the resistance hereafter) of the developing roller 14 will be described. FIG. 5 is a view illustrating measurement of the overall volume resistance of the developing roller 14. As shown in FIG. 5, the roller 14 serving as a measurement subject has a multilayer structure constituted by a conductive core metal electrode 14*a* made of stainless steel or the like, the rubber layer 14*b*1, which is formed on an outer periphery thereof as the elastic layer, and the alumina surface layer 14*b*2. Further, a width of the developing roller 14 in a lengthwise direction is approximately 230 mm.

In this overall resistance measurement method, a cylindrical member G1 that is made of ϕ30 mm stainless steel and rotates at a speed of approximately 48 mm/sec is used. During resistance measurement, the developing roller 14 rotates in accordance with the rotation of the cylindrical member G1. An end portion roller (not shown) that limits a penetration level into the cylindrical member G1 (keeps a contact region between the roller 14 and the cylindrical member G1 constant) is fitted to an end portion of the developing roller 14. The end portion roller is formed in a cylindrical shape having an outer diameter of 80 μm, which is smaller than the outer diameter of the developing roller 14. F in FIG. 5 denotes a load exerted on respective end portions of the developing roller 14 (respective end portions of the conductive core metal electrode 14*a*), and during measurement, the developing roller 14 is pressed toward the cylindrical member G1 side by a total load of 1 kg-force, i.e. 500 g-force on each side.

Further, a measurement circuit G2 shown in FIG. 5 is used in the measurement method. The measurement circuit G2 is constituted by a power supply Ein, a resistor Ro, and a voltmeter Eout. In this measurement method, measurement is performed at Ein: 300 V (DC). Further, a resistor having a resistance value of 100Ω to 10 MΩ can be used as the resistor Ro. Note that the resistor Ro is used to measure a weak current, and therefore preferably has a resistance value of between $10^{-2}$ times and $10^{-4}$ times the resistance of the developing roller 14 serving as the measurement subject. In other words, when the resistance value of the developing roller 14 is approximately $1\times10^6\Omega$, the resistance value of the resistor Ro is preferably approximately 1 kΩ. When the measurement circuit G2 is used, a resistance value Rb of the developing roller 14 is calculated from $Rb=Ro\times(Ein/Eout-1)\Omega$. Note that a value obtained ten seconds after applying a voltage was measured as Eout.

<<Measurement of Volume Resistivity of Each Layer>>

Figure 6:
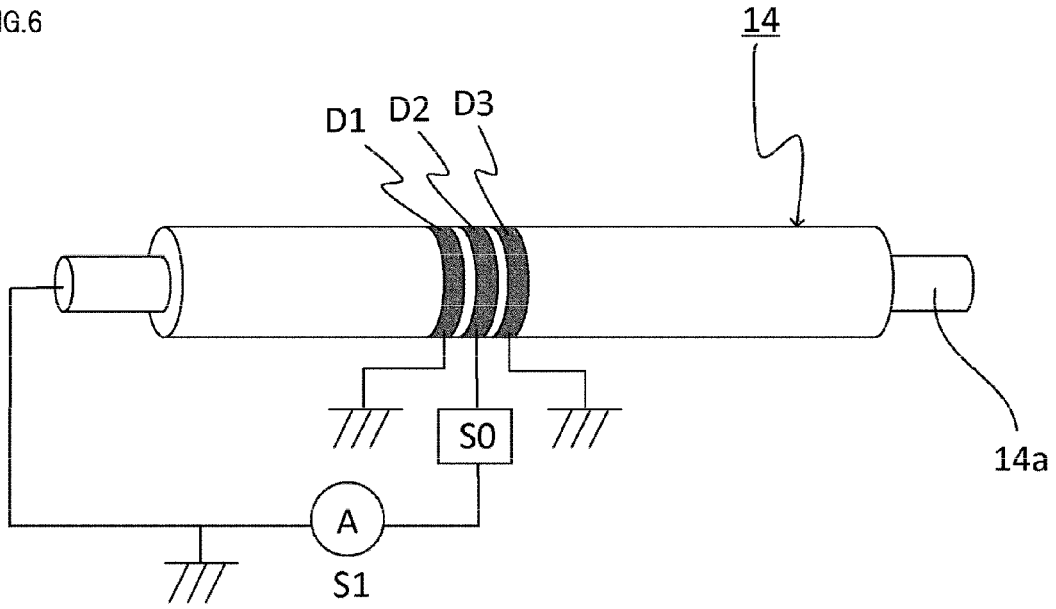
FIG. 6 is a view illustrating measurement of a volume resistivity of each layer of the developing roller.

Next, referring to FIG. 6, a volume resistivity (also referred to simply as a resistivity hereafter) of each layer will be described. FIG. 6 is a view illustrating measurement of the volume resistivity of each layer of the developing roller. In the first example, the volume resistivity of the alumina surface layer 14*b*2 is $5\times10^{11}$ Ωcm, and the volume resistivity of the rubber layer 14*b*1 is $1\times10^8$ Ωm. In other words, in the first example, the alumina surface layer 14*b*2 has a higher volume resistivity than the rubber layer 14*b*1.

The resistivity is measured as follows. As shown in FIG. 6, three strips of conductive tape having a width of 5 mm are wound around the surface of the developing roller 14 at 1 mm intervals, whereupon a voltage to be described below, which is obtained by superimposing an alternating current on a direct current, is applied from a power supply S0 between the core metal electrode 14*a* of the developing roller 14 and a conductive tape D2 positioned in the center of the three strips of conductive tape.

The two strips of conductive tape D1 and D3 other than the central conductive tape D2 are grounded to earth, and the volume resistivity of the developing roller 14 in a radial direction is measured by detecting a current flowing between the central conductive tape D2 and the core metal electrode 14*a* using an ammeter S1. The voltage applied here is obtained by varying a direct current voltage of 20 V and an alternating current voltage of Vpp 1V between frequencies of 1 Hz to 1 Me Hz, and the volume resistance of each layer is calculated by plotting Col-Col. Further, a cross-section of the developing roller 14 is cut out, a film thickness of each layer is measured at 10 points using SEM observation, an average film thickness of each layer is calculated, and the volume resistivity of each layer is calculated from the aforesaid volume resistance. Here, impedance measurement was implemented in an environment of 30° C. and 80% RH.

Figure 9A:
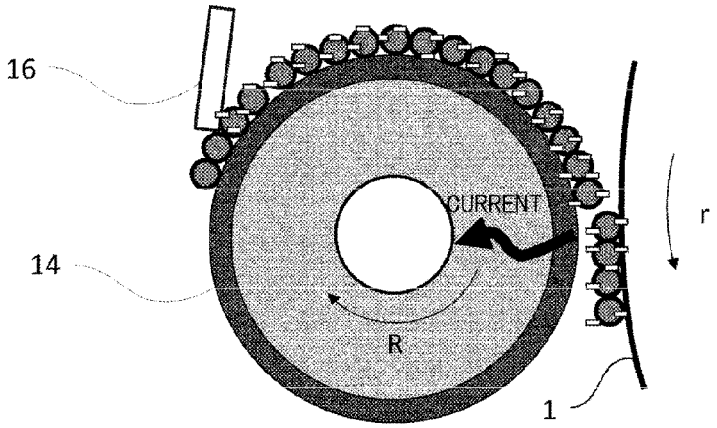
FIGS. 9A to 9C are views showing current paths through the developing nip portion.
Figure 9B:
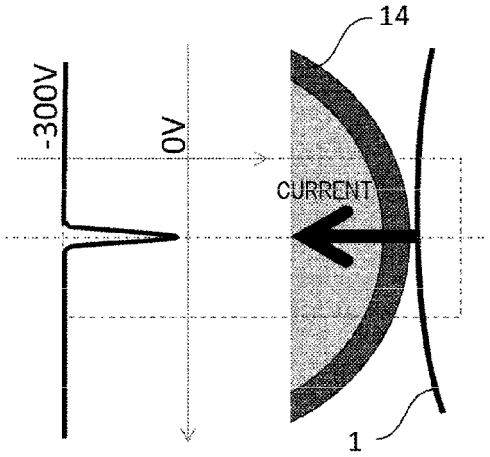
Figure 9C:
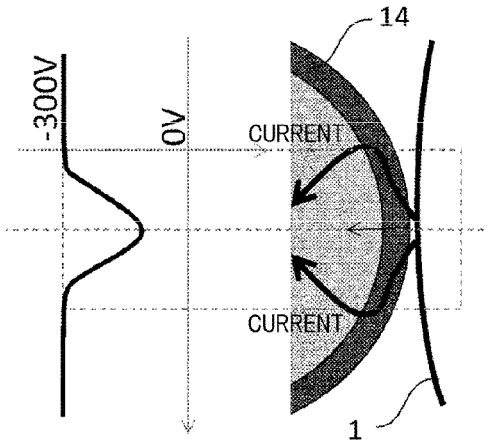

As a result of committed research, the inventors found that by setting a relationship between the volume resistivity of the surface layer 14*b*2 and the volume resistivity of the rubber layer 14*b*1 as described above, favorable images can be obtained. First, referring to FIGS. 9A to 9C, density variation and gradation variation corresponding to the relationship between the resistivity of the surface layer 14*b*2 and the resistivity of the rubber layer 14*b*1 will be investigated. FIGS. 9A to 9C are views showing current paths through the developing nip portion. Normally, to obtain a stable image, an appropriate potential difference is provided between the photosensitive drum 1 and the developing roller 14 by adjusting the resistance of the rubber layer 14*b*1 so that the desired image density and gradation can be obtained.

In this example, the surface layer 14*b*2 is formed to have a higher volume resistivity than the rubber layer 14*b*1, and in so doing, it is believed that variation in the image density and gradation can be suppressed. As shown in FIG. 9A, when the charged toner on the developing roller 14 is developed from the developing roller 14 onto the photosensitive drum 1, an amount of charge corresponding to the movement of the developed toner also flows to the developing roller 14. When the surface layer 14*b*2 is provided to have a lower resistance than the volume resistivity of the rubber layer 14*b*1, a current generated at this time is more likely to flow along a path passing through the surface layer 14*b*2, as shown in FIG. 9C. As a result, a voltage drop of a predetermined value occurs on either side of the developing nip portion N where the developing roller 14 contacts the photosensitive drum 1, leading to variation in a desired electric field intensity during development, and corresponding variation in the image density and gradation. Furthermore, when the thickness of the layer is increased in this condition, the amount of current flowing through the surface layer 14*b*2 increases further, leading to a further reduction in electric field intensity in the developing nip portion N.

In this example, on the other hand, the surface layer 14*b*2 having a higher resistivity than the resistivity of the rubber layer 14*b*1 is provided, and therefore a sneak current can be suppressed dramatically (FIG. 9B), whereby a reduction in the electric field intensity in the developing nip portion N can be suppressed. As a result, the image density and gradation can be obtained as desired. Hence, in this example, a favorable image can be obtained by making the resistivity of the surface layer 14*b*2 higher than the resistivity of the rubber layer 14*b*1.

Further, to suppress the current flowing through the surface layer 14*b*2 and suppress a dramatic increase in overall resistance, the average film thickness of the surface layer 14*b*2 is preferably set at or below 5.0 μm. When the average film thickness of the surface layer 14*b*2 is larger than 5.0 μm, the sneak current can be suppressed but the voltage drop on the surface layer increases, leading to a reduction in the intensity of the electric field applied to the toner layer in the developing nip, and as a result, the amount of toner that can be developed decreases, leading to a reduction in density. In this example, the average film thickness of the surface layer 14*b*2 is 1.5 μm.

Next, causes of fog in a high humidity environment will be described. It is believed that fog is mainly generated when the toner charge is lost in the developing nip portion N between the developing roller 14 and the photosensitive drum 1 such that the toner cannot be controlled using an electric field, with the result that the toner contacts the photosensitive drum 1 so as to be transferred to a non-image portion.

Figure 7:
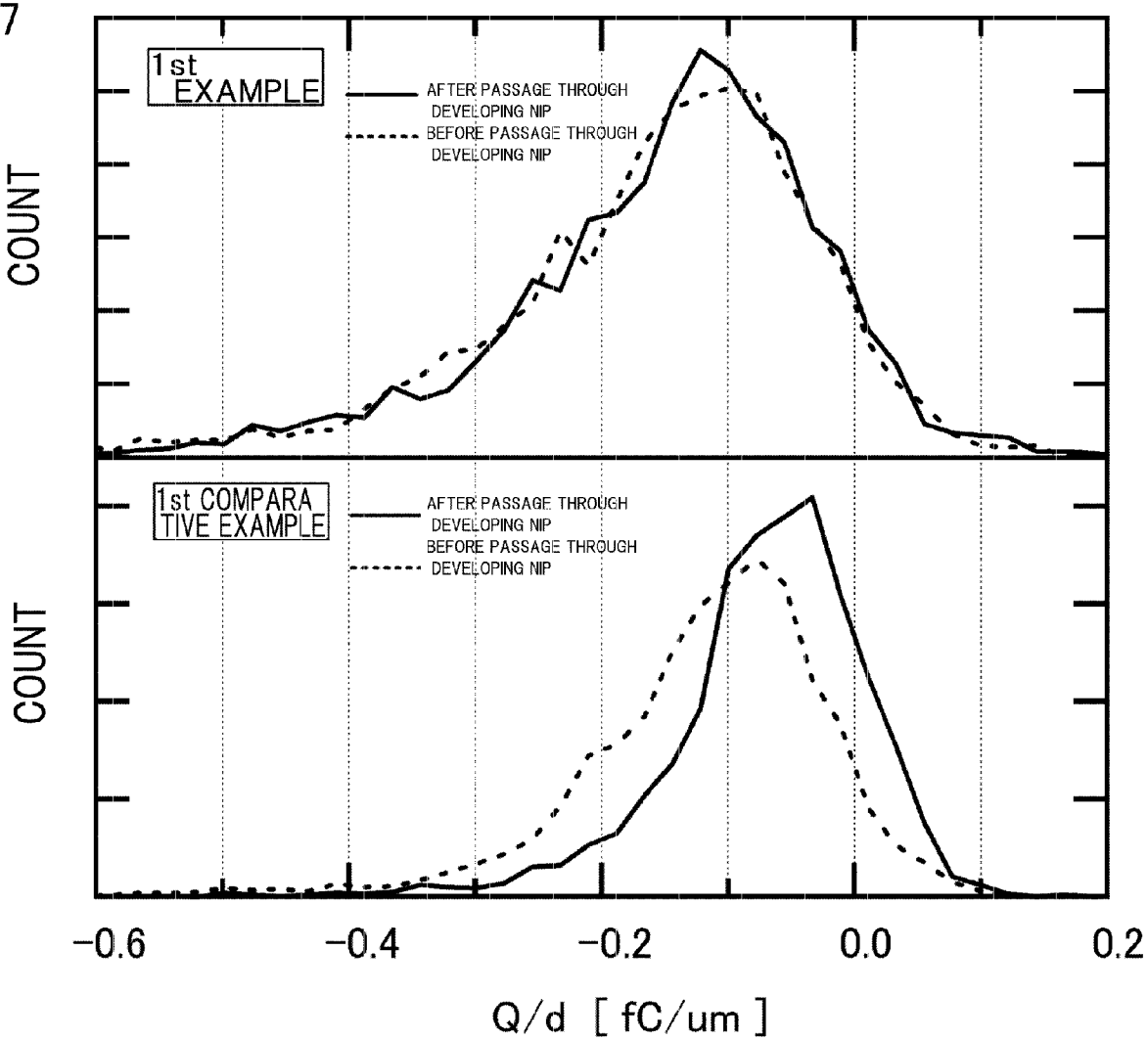
FIG. 7 is a graph showing a charge amount of a toner coating layer before and after passage through a developing nip portion.

The occurrence of fog is verified by switching a main body power supply OFF while passing a solid white sheet, measuring a charge amount distribution of the toner on the developing roller 14, measuring the charge amount distribution of the toner on the developing roller 14 before and after passage through the developing nip portion N, and evaluating an amount of variation therein. FIG. 7 shows the charge amount distribution on the developing roller 14 before and after passage through the developing nip portion N, where the photosensitive drum 1 and the developing roller 14 come into contact with each other, when a developing roller 14 according to a first comparative example, to be described below, is used. It was found that in the first comparative example, which corresponds to the related art, the charge amount of the toner following passage through the developing nip portion N is greatly reduced in comparison with the charge amount prior to passage.

Here, using FIG. 7, the charge amount of the toner coating layer on the developing roller 14 before and after passage through the developing nip portion N will be described. FIG. 7 is a graph showing the charge amount of the toner coating layer before and after passage through the developing nip portion according to the first example and the first comparative example.

The abscissa in FIG. 7 shows Q/d [fC/μm]. Q is the charge amount of one toner sample, and d is a toner particle diameter, which was measured using an E-spart analyzer, manufactured by Hosokawa Micron Group. Toner charge amount decay increases particularly as the intensity of an electric field formed between the photosensitive drum 1 and the developing roller 14 increases. In other words, the amount of fog increases as the intensity of the electric field formed between the photosensitive drum 1 and the developing roller 14 increases. Further, similarly to the electric field intensity, the amount of toner charge decay increases as the process speed decreases, leading to an increase in the amount of fog. The reason for this is that a time required for the toner on the developing roller to pass through the developing nip portion N where the photosensitive drum 1 and the developing roller 14 contact each other increases, causing toner charge decay to advance.

To obtain a toner charge decay suppression effect, the average film thickness of the surface layer 14*b*2 is preferably no smaller than 0.01 μm. When the average film thickness of the surface layer 14*b*2 is smaller than 0.01 μm, the surface layer 14*b*2 cannot sufficiently cover the elastic layer 14*b*1, and it may be assumed that toner charge decay cannot be suppressed in the uncovered part.

Further, to obtain the toner charge amount decay suppression effect and an image density variation suppression effect with stability, the average film thickness of the surface layer is even more preferably no smaller than 0.1 μm and no greater than 2.5 μm. When the average film thickness is smaller than 0.1 μm, variation exists in the film thickness of the surface layer 14*b*2 such that a part having a thickness at or below 0.01 μm or a part in which the surface layer is not formed may occur, leading to a small increase in fog. When the film thickness is greater than 2.5 μm, on the other hand, parts having a large film thickness may occur locally, leading to a small reduction in the evenness of the image density.

Moreover, the resistivity of the surface layer 14*b*2 is preferably no lower than $10^{10}$ Ωcm and no higher than $10^{14}$ Ωcm. When the resistivity of the surface layer 14*b*2 is higher than $10^{14}$ Ωcm, variation in the surface layer film thickness causes a small reduction in the evenness of the image density. When the resistivity of the surface layer 14*b*2 is lower than $10^{10}$ Ωcm, variation in the surface layer film thickness causes local toner charge decay, and therefore a small increase in the amount of fog is likely to occur.

<<Measurement of Hardness>>

A hardness (an average hardness) of the developing roller 14 was measured using an Asker-C durometer (manufactured by Kobunshi Keiki Co., Ltd.). The developing roller 14 used in the present invention preferably has an average Asker-C hardness of more than 30 degrees and less than 80 degrees (Asker-C). When the average hardness is equal to or higher than 80 degrees (Asker-C), the toner melts when it rubs against the developing roller 14, unfavorably leading to blade melt adhesion and roller melt adhesion. Further, a contact condition between the developing roller 14 and the photosensitive drum 1 is likely to become unstable. When the average hardness is equal to or lower than 30 degrees (Asker-C), on the other hand, permanent deformation occurs due to compression set, making the developing roller 14 difficult to use. Note that the average hardness of the developing roller 14 used in this example is set at 55 degrees (Asker-C).

<<Measurement of Microhardness>>

A microhardness of this example was set at 150 MPa. A TriboScope apparatus manufactured by HYSITRON was used to measure the microhardness. During the measurement, a Berkovich indenter tip of R 150 nm was displaced from a no load condition to a maximum load condition in five seconds and then displaced to the no load condition in five seconds without being held, whereupon the microhardness was calculated from the load variation. The maximum load at this time was set as the load amount obtained when the average film thickness of the surface layer was displaced by 10%.

<<Measurement of Pore Distribution>>

A pore distribution of the surface layer **14*b*2** was measured using the Tristar 3000, manufactured by Micromeritics. In this example, an average diameter of the pore distribution was 0.5 nm.

First Comparative Example

The developing roller 14 according to the first comparative example corresponding to the related art will now be described. The following description focuses mainly on differences with the first example. The developing roller 14 used in the first comparative example was manufactured as follows. The conductive silicon rubber layer **14*b* containing a conductive agent was provided on the periphery of the core metal electrode 14*a* having an outer diameter of ϕ6 (mm) and serving as a conductive support member. The surface of the silicon rubber layer 14*b* was coated with 10 μm of urethane resin through which roughening particles and a conductive agent were dispersed, whereby the outer diameter was set at ϕ11.5 (mm). The resistance of the developing roller 14** was $5\times10^5\Omega$, and the average hardness (Asker-C) was 55 degrees.

Second Comparative Example

The developing roller 14 according to a second comparative example will now be described. The following description focuses mainly on differences with the first example. The developing roller 14 used in the second comparative example was manufactured as follows. The conductive silicon rubber layer **14*b*1 containing a conductive agent was provided on the periphery of the core metal electrode 14*a* having an outer diameter of ϕ6 (mm) and serving as the conductive support member. The surface of the silicon rubber layer 14*b* was coated with 10 μm of urethane resin, whereby the outer diameter was set at ϕ11.5 (mm). The resistance of the developing roller 14** was $5\times10^6\Omega$, and the average hardness (Asker-C) was 55 degrees. Further, the surface layer resistivity was $10^9$ Ωcm, and the rubber layer resistivity was $10^9$ Ωcm.

Second Example

The developing roller 14 according to a second example will now be described. The following description focuses mainly on differences with the first example. The developing roller 14 used in the second example was manufactured as follows. The conductive silicon rubber layer **14*b*1 containing a conductive agent was provided on the periphery of the core metal electrode 14*a* having an outer diameter of ϕ6 (mm) and serving as the conductive support member, whereby the outer diameter was set at ϕ11.5 (mm). In the second example, urethane rubber was used as the rubber layer 14*b*1. Next, a colloidal alumina solution was prepared, and the developing roller 14 having the conductive elastic layer described above was dipped in the colloidal alumina solution to form the alumina surface layer 14*b*2** at 1.5 μm.

The colloidal alumina solution used here was prepared by stirring and mixing together alumina sol liquid 520, manufactured by Nissan Chemical Industries Ltd., and ethanol to a volume ratio of 1:4. Furthermore, in the second example, the rubber layer **14*b*1 of the developing roller 14 was subjected to UV irradiation before being dipped in order to improve the coating performance and the adhesiveness of the colloidal alumina solution. After forming the alumina surface layer 14*b*2, the developing roller 14 was dried for fifteen minutes at 80° C. The resistance of the developing roller 14 was approximately $10^5\Omega$, and the average hardness (Asker-C) was 60 degrees. Further, the resistivity of the alumina surface layer 14*b*2** was $2\times10^{10}$ Ωcm, and the rubber layer resistivity was $10^8$ Ωcm. Furthermore, the surface layer hardness according to a nanoindentation method was 120 MPa.

Third Example

The developing roller 14 according to a third example will now be described. The following description focuses mainly on differences with the first example. The developing roller 14 used in the third example was manufactured as follows. The conductive rubber layer **14*b* containing a conductive agent was provided on the periphery of the core metal electrode 14*a* having an outer diameter of ϕ6 mm and serving as the conductive support member, whereby the outer diameter was set at ϕ11.5 mm. Further, an aluminum oxide film of approximately 200 nm was formed as the surface layer 14*b*2 by performing vacuum deposition on the manufactured developing roller. More specifically, an aluminum oxide film was formed as the surface layer 14*b*2 of the developing roller 14 by vaporizing Al203 granules through electron beam heating. The resistance of the developing roller 14** was $5\times10^5\Omega$, and the average hardness (Asker-C) was 55 degrees. Further, the surface layer resistivity was $8\times10^{13}$ Ωcm, and the rubber layer resistivity was $10^8$ Ωcm. Furthermore, the surface layer hardness according to the nanoindentation method was 200 MPa.

Third Comparative Example

The developing roller 14 according to a third comparative example will now be described. The following description focuses mainly on differences with the first example. The developing roller 14 used in the third comparative example was manufactured as follows. A conductive rubber layer containing a conductive agent was provided on the periphery of the core metal electrode **14*a* having an outer diameter of ϕ6 mm and serving as the conductive support member, whereby the outer diameter was set at ϕ11.5 mm. Further, an aluminum metal film of approximately 200 nm was formed by subjecting the manufactured developing roller 14 to vacuum deposition. More specifically, an aluminum metal film was formed on the surface of the developing roller 14** by vaporizing Al metal through resistance heating. The resistance of the developing roller was $5\times10^5\Omega$, and the average hardness (Asker-C) was 55 degrees. Further, the surface layer resistivity was 10 Ωcm, and the rubber layer resistivity was $10^9$ Ωcm. Furthermore, the surface layer hardness according to the nanoindentation method was 50 MPa.

<<Evaluation Methods>>

An image density evaluation, a fog evaluation, and a solid density difference evaluation performed in cases where the developing rollers of the respective examples and comparative examples are applied to the image forming apparatus according to the first embodiment will be described below. Further, an initial fog evaluation and a halftone density evaluation performed in cases where the developing rollers of the respective examples and comparative examples are applied to the image forming apparatus according to the second embodiment will be described below. Hereafter, evaluations performed after passing 100 sheets will be referred to as "initial", and evaluations performed after passing 3000 sheets will be referred to as "durable".

<Evaluation Methods of First Embodiment>

Evaluation methods used in the first embodiment will now be described.

[Image Density Evaluation]

The image density evaluation was performed after leaving the image forming apparatus in an evaluation environment of 30° C. and 80% RH for one day in order to become accustomed to the environment, and after printing 100 sheets and 3000 sheets. The 100 sheet and 3000 sheet printing tests were performed by continuously passing sheets printed with a recorded image of horizontal lines having an image ratio of 5%. The evaluation obtained after passing 100 sheets was set as an initial image density, and the evaluation obtained after passing 3000 sheets was set as a durable image density.

Further, in the image density evaluation, three solid black images were output continuously, ten points were extracted in a sheet plane of the three solid black images, and an average value thereof was set as a solid black image density. Here, the solid image density was evaluated using a Spectrodensitometer 500 (manufactured by X-Rite Inc.). The printing tests and the evaluation images were output in monochrome at the normal sheet speed (120 mm/sec). The image density was evaluated using symbols ○, Δ, and x, described below.

○: A 10-point average on the solid black image of no less than 1.3

Δ: A 10-point average on the solid black image of no less than 1.1 and less than 1.3 x: A 10-point average on the solid black image of less than 1.1

[Fog Evaluation]

Fog is an image defect appearing as scumming when a small amount of toner is developed in a white portion (an unexposed portion) where printing is not intended. Fog is generated when the toner charge decays or the polarity of the toner reverses in the developing nip portion N where the photosensitive drum 1 contacts the developing roller 14. It is known that a charge-providing performance in relation to the toner deteriorates particularly in a high humidity environment. When the charge-providing performance in relation to the toner deteriorates, the charge of the toner decays, leading to an increase in the amount of fog.

A fog amount evaluation method was implemented as follows. An operation of the image forming apparatus was stopped during printing of a solid white image. Toner existing on the photosensitive drum 1 after the developing process and before the transfer process was transferred onto transparent tape, whereupon the tape carrying the toner was adhered to a recording sheet or the like. Tape not carrying toner was adhered to the same recording sheet simultaneously. An optical reflectance through a green filter was measured from above the tape adhered to the recording sheet using an optical reflectance gauge (TC-6DS, manufactured by Tokyo Denshoku), and an amount of reflectance corresponding to fog was determined by subtracting the measured optical reflectance from a reflectance of the tape not carrying the toner. The result was evaluated as the amount of fog. The amount of fog was measured at three or more points on the tape, and an average value thereof was determined. The fog was evaluated using symbols ○, Δ, x, and xx, described below.

○: A fog amount of less than 1.0%

Δ: A fog amount of no less than 1.0% and less than 3.0% x: A fog amount of no less than 3.0% and less than 5.0% xx: A fog amount of 5.0% or more

The fog evaluation was performed after leaving the image forming apparatus in a test environment of 30° C. and 80% RH for 24 hours, and after printing 100 sheets and 3000 sheets. The printing tests were performed by continuously passing sheets printed with a recorded image of horizontal lines having an image ratio of 5%. More specifically, an image formed by repeatedly printing one dot line and leaving nineteen dot lines unprinted was used here as an image of horizontal lines having an image ratio of 5%. Furthermore, the sheets were passed continuously at the normal speed (120 mm/sec), while the fog evaluation was implemented in the low speed mode (60 mm/sec). The evaluation obtained after passing 100 sheets was set as initial fog, and the evaluation obtained after passing 3000 sheets was set as durable fog.

[Solid Density Difference Evaluation]

The solid density difference evaluation was performed after leaving the image forming apparatus in an evaluation environment of 30.0° C. and 80% RH for 24 hours in order to become accustomed to the environment, and after printing 100 sheets. The 100 sheet printing test was performed by continuously passing sheets printed with a recorded image of horizontal lines having an image ratio of 5%. The solid density difference evaluation was performed by outputting a single solid black image and evaluating a density difference between a front end and a rear end of the output solid image using the Spectrodensitometer 500 (manufactured by X-Rite Inc.). The printing test and the evaluation image were output in monochrome at the normal sheet speed (120 mm/sec). The evaluation was made using symbols ○ and x, described below.

○: The density difference of the solid image between the sheet front end and the sheet rear end is less than 0.2 x: The density difference of the solid image between the sheet front end and the sheet rear end equals or exceeds 0.2

[Evaluation of Evenness of Halftone Image after Repeated Use]

The evenness of a halftone image after repeated use was evaluated after leaving the image forming apparatus in 30.0° C. and 80% RH for 24 hours in order to become accustomed to this environment, and after printing 3000 sheets. The 3000 sheet printing test was performed by continuously passing sheets printed with a recorded image of vertical lines having an image ratio of 5%. The printing test and the evaluation image were output in monochrome at the normal speed (120 mm/sec). The evaluation was made using the symbols ○ and x, described below. In this evaluation, the halftone image is a striped pattern obtained by recording a single line and then leaving four lines unrecorded in a main scanning direction. The halftone image represents an overall halftone density.

○: Vertical line-shaped grayscale unevenness cannot be recognized visually on the halftone image x: Vertical line-shaped grayscale unevenness can be recognized visually on the halftone image <Evaluation Methods of Second Embodiment>

Evaluation methods used in the second embodiment will now be described.

(Initial Fog Evaluation in Cleanerless System)

Initial fog in the cleanerless system according to the second embodiment was evaluated identically to the initial fog evaluation of the first embodiment, and therefore description thereof has been omitted.

[Initial Halftone Density Evaluation in Cleanerless System]

The initial halftone density in the cleanerless system according to the second embodiment was evaluated after leaving the image forming apparatus in an evaluation environment of 30.0° C. and 80% RH for 24 hours in order to become accustomed to the environment, and after printing 100 sheets. The 100 sheet printing test was performed by continuously passing sheets printed with a recorded image of horizontal lines having an image ratio of 5%. In the image evaluation, a single halftone image was printed. Next, twenty sheets printed with an image of a vertical stripe having a width of 2 cm were passed continuously, whereupon the halftone image was printed again onto a twenty-first sheet also passed continuously. The printing test and the evaluation image were output in monochrome at the normal speed (120 mm/sec). The halftone density was evaluated using symbols ○ and x described below. In this evaluation, the halftone image is a striped pattern obtained by recording a single line and then leaving four lines unrecorded in a main scanning direction. The halftone image represents the overall halftone density.

○: A density difference cannot be recognized visually between the halftone images on the first and twenty-first sheets x: A density difference can be recognized visually between the halftone images on the first and twenty-first sheets (Evaluation Results)

Table 1 shows results of the respective evaluations described above.

In the first example of the present invention, toner charge decay is suppressed effectively by forming the high-resistance alumina surface layer 14*b*2. In particular, toner charge decay in the developing nip portion N is suppressed even when the charge-providing performance in relation to the toner decreases after repeated use, and therefore the amount of fog can be suppressed. In addition, the alumina surface layer 14*b*2 has an ability to charge the toner negatively, and therefore an increase in the amount of fog can be suppressed dramatically (see FIG. 7).

The initial image density is favorable in both the first example and the first comparative example. In the first example, the high-resistance surface layer 14*b*2 is formed as a thin layer, and therefore a similar image density to that of a conventional image forming apparatus can be obtained. In the first comparative example, however, the image density decreases after repeated use. The reason for this is believed to be that after repeated use, the toner charging ability deteriorates, leading to a reduction in transfer efficiency, and as a result, the amount of toner reaching the sheet decreases.

TABLE 1

| | Film thickness [um] | Surface layer resistivity [Ω · cm] | Rubber layer resistivity [Ω · cm] | Overall resistance [Ω] | Average hardness [°] (AskerC) | Microhardness [MPa] | Average diameter of pore distribution [nm] |
|---|---|---|---|---|---|---|---|
| 1st example | 1.5 | 5 × 10^11 | 1 × 10^8 | 5 × 10^5 | 55 | 150 | 0.5 |
| 1st comparative example | — | — | 1 × 10^8 | 5 × 10^5 | 55 | — | — |
| 2nd comparative example | 10 | 1 × 10^9 | 1 × 10^9 | 5 × 10^6 | 55 | — | — |
| 3rd comparative example | 0.2 | Conductive | 1 × 10^8 | 5 × 10^5 | 55 | 50 | 0.05 |
| 2nd example | 1.5 | 2 × 10^10 | 1 × 10^8 | 5 × 10^5 | 60 | 120 | 2.0 |
| 3rd example | 0.2 | 8 × 10^13 | 1 × 10^8 | 5 × 10^5 | 55 | 200 | 0.05 |

| | 1st embodiment | | | | | | 2nd embodiment | |
|---|---|---|---|---|---|---|---|---|
| | Initial image density | Durable image density | Initial fog | Durable fog | Solid density difference | Evenness of halftone image | Initial fog | Halftone density |
| 1st example | ○ | ○ | ○ | ○ | ○ | ○ | ○ | ○ |
| 1st comparative example | ○ | X | X | XX | ○ | ○ | XX | X |
| 2nd comparative example | Δ | X | Δ | X | Δ | ○ | XX | X |
| 3rd comparative example | ○ | Δ | ○ | Δ | X | ○ | X | X |
| 2nd example | ○ | Δ | Δ | Δ | ○ | ○ | Δ | ○ |
| 3rd example | ○ | ○ | ○ | ○ | ○ | X | ○ | ○ |

First, the first example and the first comparative example will be compared on the basis of the evaluation results of the first embodiment.

In the evaluation results of the first embodiment, an increase in the amount of fog is observed in the first comparative example that does not include the surface layer 14*b*2. The reason for this is believed to be that the toner charge decays by a large amount in the developing nip portion N, and after repeated use in particular, the charge-providing performance in relation to the toner decreases in addition to the toner charge decay, leading to a dramatic increase in the amount of fog. In the first example of the present invention, on the other hand, the amount of fog is suppressed even after repeated use.

Furthermore, in the first embodiment, a potential difference is provided between the developing roller 14 and the regulating blade 16 in order to stabilize the toner coating layer on the developing roller 14. The potential difference is provided in a direction for pushing a negative charge toward the developing roller 14 side, and therefore a force acts to orient the negatively charged toner and the charge on the toner surface toward the developing roller 14 side. Accordingly, toner charge decay occurs likewise in the blade nip portion where the regulating blade 16 contacts the developing roller 14, leading to a dramatic reduction in the toner charge amount. As a result, toner having a smaller charge amount is supplied to the drum, and therefore the toner is less likely to move in a transfer nip portion (an opposing position between the photosensitive drum 1 and the primary transfer apparatus 5).

In the first example, in addition to the charge-providing performance of the alumina surface layer 14*b*2, toner charge decay can be suppressed with stability in the developing nip portion N and the blade nip portion where the toner contacts the regulating blade 16 even when the toner deteriorates after repeated use such that the charge-providing performance in relation to the toner decreases. As a result, superior transferability can be maintained.

Next, the evaluation results of the second embodiment will be described.

The second embodiment is an example in which the cleaning blade 9 is not provided, and therefore untransferred toner remaining on the photosensitive drum 1 is charged negatively while passing the charging roller 2 and then collected by the developing assembly 4 in the developing nip portion N. Further, in this example, Vback is increased to 500 V in order to improve a collection performance by which return toner is collected in the developing nip portion N. In the first comparative example corresponding to the related art, since Vback is large, a large amount of toner charge decay occurs during passage through the developing nip portion N, and as a result, an increase in the amount of fog is observed. Moreover, in the first comparative example, in addition to the large amount of fog, the amount of residual toner that cannot be transferred is large, and therefore an extremely large amount of toner reaches a contact region between the charging roller 2 and the photosensitive drum 1. Hence, a large amount of toner accumulates on the surface of the charging roller 2, and therefore a desired charging performance cannot be obtained. As a result, variation occurs in the halftone image density.

In the first example of the present invention, on the other hand, since Vback is large in the second embodiment, a favorable image can be obtained even though the toner charge is more likely to decay during passage through the developing nip portion N. The reason for this is that in the first example of the present invention, toner charge decay can be suppressed effectively and the toner can be charged favorably, and therefore a dramatic increase in the amount of fog can be suppressed. Accordingly, superior transferability can be maintained, and therefore the amount of residual untransferred toner can be reduced dramatically. As a result, variation in the halftone image density caused by soiling of the charging roller can be suppressed.

With the developing roller 14 according to the first example of the present invention, described above, favorable images can be obtained with stability in both embodiments. In the cleanerless system of the second embodiment, the amount of untransferred toner remaining on the photosensitive drum 1 can be suppressed dramatically, and therefore soiling of the charging roller 2 can be suppressed. Even when Vback is set to be large in order to improve the collecting performance, the amount of fog can be suppressed, and therefore the untransferred residual toner can be collected in the developing assembly 4 effectively.

<<Superiority of Examples>>

The superiority of the examples of the present invention over the comparative examples will now be described.

In the first embodiment, the amount of fog occurring in the second comparative example, although smaller than that of the first comparative example, remains large. In the second comparative example, a urethane layer not containing carbon is provided on the surface in order to suppress the amount of toner decay during passage through the developing nip portion N. Hence, the amount of charge decay following passage is slightly reduced, and therefore an increase in the amount of fog is suppressed.

However, the charge-providing performance in relation to the toner is poor, and therefore, with the cleanerless system serving as the second embodiment, the amount of fog increases in a similar manner to the first comparative example. Moreover, the transferability is also poor, and therefore variation in the halftone image density occurs due to soiling of the charging roller. Furthermore, the resistivity is approximately identical to that of the rubber layer, while the film thickness is greater than that of the rubber layer, and therefore the initial image density decreases slightly.

In the third comparative example, the aluminum metal film covers the surface in order to improve the charge-providing performance. Since the average film thickness is only 0.2 initial image density variation is not observed. In the first embodiment, the charge-providing performance is favorable, and therefore an increase in the amount of fog is also suppressed. However, since a low-resistance layer is formed, the toner charge decays during passage through both the developing nip portion N and the blade nip portion. As a result, when deterioration of the toner advances due to repeated use such that the toner charging performance deteriorates, the amount of fog increases, and the image density decreases due to deterioration of the transferability.

In the cleanerless system of the second embodiment, Vback is large, and therefore the toner charge decays greatly during passage through the developing nip portion N, leading to an increase in the amount of fog. Accordingly, the fog toner reaches and accumulates on the charging roller 2 without being transferred, and as a result, variation occurs in the halftone image density due to a reduction in transferability. Further, the toner that is returned to the developing assembly 4 without being developed is normally peeled away by the supply roller 15 such that the toner on the developing roller 14 is refreshed, and as a result, a development history is suppressed.

In the third comparative example, the charge-providing performance in relation to the toner is extremely high, and therefore the toner is not peeled away favorably by the supply roller 15. As a result, a density difference occurs in the solid density between the front end and the rear end. The reason why a density difference occurs in the solid image between the front end part of the solid image, which is generated during a single rotation of the developing roller, and a part generated thereafter when the peeling performance deteriorates can be described briefly as follows. When the toner peeling performance is poor, the part corresponding to a single rotation of the developing roller is held on the developing roller 14 for several rotations without being printed by a previous rotation or the like prior to formation of the image. As a result, excessively charged toner and toner having a small particle diameter, which is more difficult to peel away, are likely to accumulate. As regards the solid density generated by a second rotation of the developing roller onward, on the other hand, the toner is supplied to the developing roller from the supply roller so as to be immediately supplied to the developing roller. Accordingly, the toner charge amount, the particle diameter, and so on of toner coating layer differ from previous values. As a result, when the solid density image is printed, a difference in density occurs between the part generated by a single rotation of the developing roller and the subsequent part.

In the first example of the present invention, on the other hand, the alumina surface layer 14*b*2 is formed, and therefore the toner is charged with an appropriate charge-providing performance. Accordingly, toner charge decay during passage through the developing nip portion N is suppressed, and therefore the amount of fog can be suppressed with stability. Further, the amount of fog can be suppressed without applying an excessive charge amount, and therefore the peeling performance of the supply roller 15 can be maintained. Hence, a difference in solid image density due to the development history can be suppressed, and as a result, stable images can be obtained.

<<Comparison of Second Example and Third Example>>

The superiority of the present invention will now be described further by comparing examples. In the second example, the surface layer resistivity is $2\times10^{10}$ Ωcm. In the third example, the surface layer resistivity is $8\times10^{13}$ Ωcm, and the average film thickness is 0.2 μm. In the second example, the resistance of the surface layer 14*b*2 is slightly low, and therefore toner charge decay occurs in the developing nip portion N, leading to a corresponding slight increase in the amount of fog. Moreover, after repeated use, an image density difference, and in the cleanerless system a halftone image density difference, occur.

In the third example, meanwhile, the high-resistance thin film is formed, but after repeated use, the evenness of the halftone density image decreases. The reason for this will now be described briefly. In the third example, the manner in which wear occurs differs between a high printing region and a low printing region, leading to resistance unevenness. More specifically, during high printing, a large amount of the toner on the developing roller 14 is consumed, and therefore the amount of toner returning to the supply roller portion is extremely small. In other words, the supply roller 15 and the developing roller 14 rub against each other directly such that the alumina surface layer 14*b*2 is more likely to become worn.

During low printing, on the other hand, the amount of the toner on the developing roller 14 that is consumed in the developing nip portion N is small, and the amount of toner returning to the supply roller 15 is large. As a result, the supply roller 15 and the developing roller 14 are less likely to rub against each other directly, and therefore the amount of wear on the alumina surface layer 14*b*2 is small. In the third example, the surface layer 14*b*2 has an extremely high resistance of $8\times10^{13}$ Ωcm, and therefore, even when slight film thickness unevenness exists, a difference occurs in the voltage drop in the developing roller 14 part even with the potential difference applied between the developing roller 14 and the photosensitive drum 1, leading to an increase in the likelihood of unevenness in the halftone image density. As a result, unevenness in the halftone density is believed to occur after repeated use, i.e. when the number of printed sheets increases. Hence, the resistivity of the alumina surface layer 14*b*2 according to the present invention is preferably no lower than $10^{10}$ Ωcm and no higher than $10^{14}$ Ωcm, and to obtain more stable images, the resistivity of the alumina surface layer 14*b*2 is more preferably no lower than $5\times10^{10}$ Ωcm and no higher than $5\times10^{13}$ Ωcm.

<<Relationships Between Average Hardness, Microhardness, and Film Thickness>>

Fourth to seventh examples and fourth to tenth comparative examples will now be described in detail in order to illustrate relationships between the average hardness, the microhardness, and the film thickness.

Fourth Example

The developing roller 14 according to a fourth example will now be described. The following description focuses mainly on differences with the first example. The developing roller 14 used in the fourth example was manufactured as follows. The conductive rubber layer 14*b*1 containing a conductive agent was provided on the periphery of the core metal electrode 14*a* having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer 14*b*1 to form the alumina surface layer 14*b*2 at 1.5 μm. The colloidal alumina solution used here was prepared by stirring and mixing together alumina sol liquid 50D, manufactured by Kawaken Fine Chemicals Co., Ltd., and ethanol to a volume ratio of 1:3. After forming the alumina surface layer 14*b*2, the developing roller 14 was dried for fifteen minutes at 140° C. The average hardness (Asker-C) of the developing roller 14 was 55 degrees, and the surface layer hardness according to the nanoindentation method was 60 MPa.

Fifth Example

The developing roller 14 according to a fifth example will now be described. The following description focuses mainly on differences with the first example. The developing roller 14 used in the fifth example was manufactured as follows. The conductive rubber layer 14*b*1 containing a conductive agent was provided on the periphery of the core metal electrode 14*a* having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer 14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for fifteen minutes at 200° C. The average hardness (Asker-C) of the developing roller 14 was 68 degrees, and the surface layer hardness according to the nanoindentation method was 210 MPa.

Sixth Example

The developing roller 14 according to a sixth example will now be described. The following description focuses mainly on differences with the first example. The developing roller 14 used in the sixth example was manufactured as follows. The conductive rubber layer 14*b* containing a conductive agent was provided on the periphery of the core metal electrode 14*a* having an outer diameter of ϕ6 (mm) and serving as a conductive support member, whereby the outer diameter of the developing roller 14 was set at ϕ11.5 (mm).

Next, a colloidal alumina solution was prepared, and the developing roller 14 was dipped in the colloidal alumina solution up to the rubber layer 14*b*1 to form the alumina surface layer 14*b*2 at 1.5 μm. The colloidal alumina solution used here was prepared by stirring and mixing together alumina sol liquid 50D, manufactured by Kawaken Fine Chemicals Co., Ltd., and ethanol to a volume ratio of 1:3. After forming the alumina surface layer 14*b*2, the developing roller 14 was dried for fifteen minutes at 140° C. The average hardness (Asker-C) of the developing roller 14 was 46 degrees, and the surface layer hardness according to the nanoindentation method was 60 MPa.

Seventh Example

The developing roller 14 according to a seventh example will now be described. The following description focuses mainly on differences with the first example. The developing roller 14 used in the sixth example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer **14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for fifteen minutes at 140° C. The average hardness (Asker-C) of the developing roller 14** was 68 degrees, and the surface layer hardness according to the nanoindentation method was 150 MPa.

Fourth Comparative Example

The developing roller 14 according to a fourth comparative example will now be described. The following description focuses mainly on differences with the first example. The developing roller 14 used in the fourth comparative example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution to form the alumina surface layer **14*b*2 at 1.5 μm. The colloidal alumina solution used here was prepared by stirring and mixing together alumina sol liquid 50D, manufactured by Kawaken Fine Chemicals Co., Ltd., and ethanol to a volume ratio of 1:3. After forming the alumina surface layer 14*b*2, the developing roller 14 was dried for fifteen minutes at 80° C. The average hardness (Asker-C) of the developing roller 14** was 43 degrees, and the surface layer hardness according to the nanoindentation method was 40 MPa.

Fifth Comparative Example

The developing roller 14 according to a fifth comparative example will now be described. The following description focuses mainly on differences with the first example. The developing roller 14 used in the fifth comparative example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer **14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for fifteen minutes at 200° C. The average hardness (Asker-C) of the developing roller 14** was 74 degrees, and the surface layer hardness according to the nanoindentation method was 210 MPa.

Sixth Comparative Example

The developing roller 14 according to a sixth comparative example will now be described. The following description focuses mainly on differences with the first example. The developing roller 14 used in the sixth comparative example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer **14*b*1 to form the alumina surface layer 14*b*2 at 1.5 μm. The colloidal alumina solution used here was prepared by stirring and mixing together alumina sol liquid 50D, manufactured by Kawaken Fine Chemicals Co., Ltd., and ethanol to a volume ratio of 1:3. After forming the alumina surface layer 14*b*2, the developing roller 14 was dried for fifteen minutes at 80° C. The average hardness (Asker-C) of the developing roller 14** was 66 degrees, and the surface layer hardness according to the nanoindentation method was 40 MPa.

Seventh Comparative Example

The developing roller 14 according to a seventh comparative example will now be described. The following description focuses mainly on differences with the first example. The developing roller 14 used in the seventh comparative example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer **14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for sixty minutes at 200° C. The average hardness (Asker-C) of the developing roller 14** was 55 degrees, and the surface layer hardness according to the nanoindentation method was 240 MPa.

Eighth Comparative Example

The developing roller 14 according to an eighth comparative example will now be described. The following description focuses mainly on differences with the first example. The developing roller 14 used in the eighth comparative example was manufactured as follows. The conductive rubber layer **14*b*1 containing a conductive agent was provided on the periphery of the core metal electrode 14*a*** having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer **14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for sixty minutes at 200° C. The average hardness (Asker-C) of the developing roller 14** was 68 degrees, and the surface layer hardness according to the nanoindentation method was 240 MPa.

Ninth Comparative Example

The developing roller 14 according to a ninth comparative example will now be described. The following description focuses mainly on differences with the first example. The developing roller 14 used in the ninth comparative example was manufactured as follows. The conductive rubber layer 14*b*1 containing a conductive agent was provided on the periphery of the core metal electrode 14*a* having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer 14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for fifteen minutes at 140° C. The average hardness (Asker-C) of the developing roller 14 was 43 degrees, and the surface layer hardness according to the nanoindentation method was 150 MPa.

Tenth Comparative Example

The developing roller 14 according to a tenth comparative example will now be described. The following description focuses mainly on differences with the first example. The developing roller 14 used in the tenth comparative example was manufactured as follows. The conductive rubber layer 14*b*1 containing a conductive agent was provided on the periphery of the core metal electrode 14*a* having an outer diameter of ϕ6 (mm) and serving as a conductive support member, whereby the outer diameter was set at ϕ11.5 (mm).

Next, a colloidal alumina solution was prepared, and the developing roller 14 was dipped in the colloidal alumina solution up to the rubber layer 14*b*1 to form the alumina surface layer 14*b*2 at 1.5 μm. The colloidal alumina solution used here was prepared by stirring and mixing together alumina sol liquid 520, manufactured by Nissan Chemical Industries Ltd., and ethanol to a volume ratio of 1:4. After forming the alumina surface layer 14*b*2, the developing roller 14 was dried for fifteen minutes at 80° C. The average hardness (Asker-C) of the developing roller 14 was 74 degrees, and the surface layer hardness according to the nanoindentation method was 120 MPa.

<<Evaluation Methods>>

(Durable Fog Evaluation)

In this evaluation, the fog is calculated identically to the durable fog evaluation of the first embodiment, and therefore description thereof has been omitted.

(Toner Charge Maintaining Performance from Initial Point to Point Following Repeated Use)

Similarly to the fog measurement described above, the image forming apparatus was stopped during printing of a solid white image. Next, the average charge amount of the toner coating layer on the developing roller 14 was measured using the E-spart analyzer manufactured by Hosokawa Micron Group, whereupon evaluations were made using the symbols ○ and x described below.

○: The average toner charge amount after printing 3000 sheets relative to the average toner charge amount after printing 100 sheets is held at or above 60%.

x: The average toner charge amount after printing 3000 sheets relative to the average toner charge amount after printing 100 sheets is less than 60%.

This evaluation was performed after leaving the image forming apparatus in a test environment of 30° C. and 80% RH for 24 hours, and after printing 100 sheets and 3000 sheets. The printing tests were performed by continuously passing sheets printed with a recorded image of horizontal lines having an image ratio of 5%. More specifically, an image formed by repeatedly printing one dot line and leaving nineteen dot lines unprinted was used here as an image of horizontal lines having an image ratio of 5%. Furthermore, the sheets were passed continuously at the normal speed (120 mm/sec), while the evaluation was implemented in the low speed mode (60 mm/sec).

(Evaluation of Toner Charge Decay Rate Following Repeated Use)

Variation in the toner charge amount before and after the toner on the developing roller 14 passes through the developing nip portion N where the photosensitive drum 1 contacts the developing roller 14 was evaluated. More specifically, similarly to the fog measurement described above, the image forming apparatus was stopped during printing of a solid white image. Next, the average toner charge amount of the toner on the developing roller 14 before and after passage through the developing nip portion N was measured using the E-spart analyzer manufactured by Hosokawa Micron Group. A toner charge decay rate was set as an average toner charge amount variation before and after passage through the developing nip portion N relative to an average toner charge amount (Q/d) before passage through the developing nip portion N, and this evaluated using the symbols described below.

○: A decay rate of less than 40% x: A decay rate no less than 40% and less than 60% xx: A decay rate of 60% or more

This evaluation was performed after leaving the image forming apparatus in a test environment of 30° C. and 80% RH for 24 hours, and after printing 3000 sheets. The printing test was performed by continuously passing sheets printed with a recorded image of horizontal lines having an image ratio of 5%. More specifically, an image formed by repeatedly printing one dot line and leaving nineteen dot lines unprinted was used here as an image of horizontal lines having an image ratio of 5%. Furthermore, the sheets were passed continuously at the normal speed (120 mm/sec), while the evaluation was implemented in the low speed mode (60 mm/sec).

Table 2 shows evaluation results.

TABLE 2

| | Average hardness [°] (AskerC) | Micro-hardness [MPa] | Toner charge amount maintaining performance | Toner charge decay rate | Durable fog |
|---|---|---|---|---|---|
| 1st example | 55 | 150 | ○ | ○ | ○ |
| 2nd example | 60 | 120 | ○ | ○ | ○ |
| 3rd example | 55 | 200 | ○ | ○ | ○ |
| 4th example | 55 | 60 | ○ | ○ | ○ |
| 5th example | 68 | 210 | ○ | ○ | ○ |
| 6th example | 46 | 60 | ○ | ○ | ○ |
| 7th example | 68 | 150 | ○ | ○ | ○ |

TABLE 2-continued

| | Average hardness [°] (AskerC) | Micro-hardness [MPa] | Toner charge amount maintaining performance | Toner charge decay rate | Durable fog |
|---|---|---|---|---|---|
| 4th comparative example | 43 | 40 | ○ | xx | x |
| 5th comparative example | 74 | 210 | x | ○ | x |
| 6th comparative example | 66 | 40 | ○ | x | x |
| 7th comparative example | 55 | 240 | ○ | x | x |
| 8th comparative example | 68 | 240 | ○ | x | x |
| 9th comparative example | 43 | 150 | ○ | x | x |
| 10th comparative example | 74 | 120 | x | ○ | x |

<<Evaluation Results>>

A relationship between the average hardness (Asker-C) and the microhardness will now be described by comparing the first to seventh examples and the fourth to tenth comparative examples on the basis of the respective evaluation results.

Figure 8:
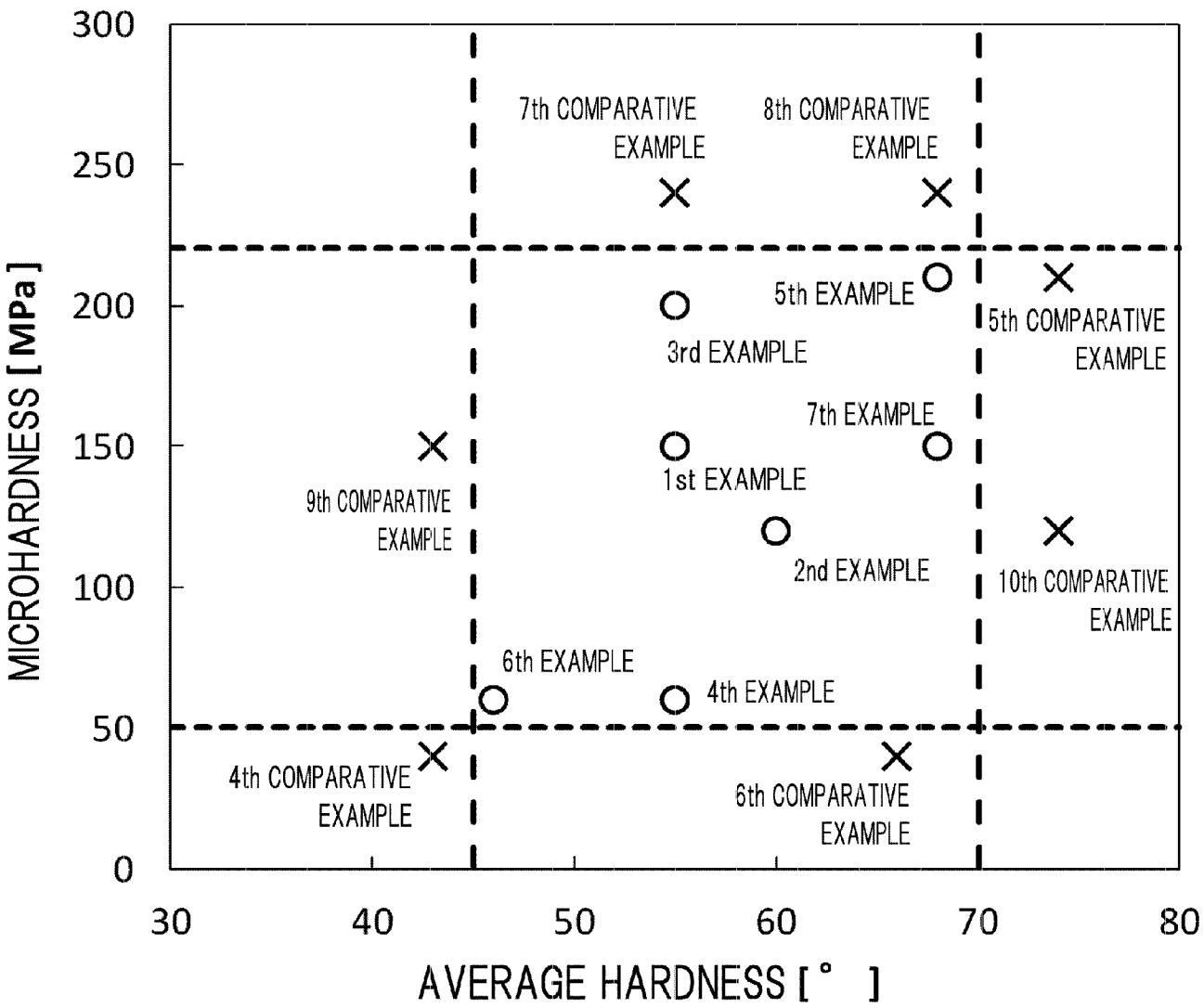
FIG. 8 is a view showing evaluation results relating to durable fog in respective examples and comparative examples.

FIG. 8 is a view showing evaluation results relating to durable fog in the respective comparative examples. First, as is evident from FIG. 8, in the fifth and tenth comparative examples, where the average hardness (Asker-C) exceeds 70 degrees, the toner charge amount maintaining performance deteriorates and the amount of fog following repeated use increases. As regards variation in the charge-providing performance and the decay rate, variation occurs mainly in the charge-providing performance. Hence, as regards the probable cause of the increase in the amount of fog, the average hardness (Asker-C) denotes the average hardness of the developing roller 14, and therefore pressure applied to the toner increases, causing external additives and the like to become more deeply implanted in the developing roller 14, and as a result, the charge-providing performance in relation to the toner deteriorates.

In the fifth and seventh examples of the present invention, on the other hand, the average hardness (Asker-C) is no higher than 70 degrees, and therefore an increase in the amount of fog can be suppressed. The reason for this is believed to be that the toner charge amount maintaining performance is favorable, and therefore toner deterioration is suppressed. Since the average hardness is low, excessive stress is not applied to the toner, and therefore toner deterioration does not advance. Further, in the fourth and ninth comparative examples, in which the average hardness (Asker-C) is likewise no higher than 70 degrees but also lower than 45 degrees, the amount of fog increases. The reason for this is that since the average hardness (Asker-C), which serves as the overall hardness of the developing roller 14, is lower than 45 degrees, the developing roller 14 deforms by a large amount upon contact with the photosensitive drum 1. The alumina surface layer **14*b*2 formed on the surface of the developing roller 14 must deform likewise. However, the alumina surface layer 14*b*2 is not as flexible as the rubber layer 14*b*1, and therefore cannot easily follow the deformation of the rubber layer 14*b*1. As a result, cracks form in the alumina surface layer 14*b*2. When the alumina surface layer 14*b*2** cracks in a high humidity environment, a gap forms therein, and as a result, the electric resistance of the surface decreases due to moisture adsorption. Accordingly, the toner charge decay suppression effect weakens, leading to an increase in the amount of fog.

Furthermore, in the fourth comparative example, the amount of fog increases by a larger amount than in the ninth comparative example. In the fourth comparative example, the average hardness (Asker-C) is smaller than 45 degrees and the microhardness is smaller than 50 MPa. When the microhardness is 50 MPa, the alumina surface layer **14*b*2 is soft, and therefore the alumina surface layer 14*b*2 becomes worn when it rubs against the members that contact the developing roller 14**. After repeated use, therefore, the film thickness decreases, leading to a reduction in the desired resistance, and accordingly, decay of the toner charge advances. As a result, the amount of fog increases dramatically.

Likewise in the sixth comparative example, the microhardness is smaller than 50 MPa, and therefore the alumina surface layer **14*b*2 is brittle. Hence, the alumina surface layer 14*b*2 becomes worn, leading to an increase in the amount of fog. In the seventh and eighth comparative examples, the amount of fog increases even though the average hardness (Asker-C) is no lower than 45 degrees and no higher than 70 degrees and the microhardness is no lower than 50 MPa. In the seventh and eighth comparative examples, the microhardness is 220 MPa, and therefore the alumina surface layer 14*b*2 is considered to be too hard to be able to follow the deformation of the rubber layer 14*b*1**. Accordingly, cracks form in a similar manner to the fourth and ninth comparative examples, leading to increases in the amount of toner decay and the amount of fog.

In the fifth example of the present invention, the microhardness is no greater than 220 MPa, and therefore the alumina surface layer **14*b*2 is able to follow the deformation of the rubber layer 14*b*1**, meaning that cracks do not form therein. As a result, decay of the toner charge amount and an increase in the amount of fog can be suppressed.

Hence, in the present invention, as described above, the Asker-C hardness is preferably no lower than 45 degrees and no higher than 70 degrees, and the microhardness is preferably no lower than 50 MPa and no higher than 220 MPa. Under these conditions, a reduction in the triboelectric charging performance due to toner deterioration in the external additives of the toner and so on, and decay of the toner charge amount due to cracks in and wear on the alumina surface layer, can be suppressed appropriately. As a result, increases in the amount of fog over time can be suppressed.

Eighth Example

An eighth example of the present invention will now be described. The following description focuses mainly on differences with the first example. The developing roller 14 used in the eighth example was manufactured as follows. The conductive rubber layer **14*b* containing a conductive agent was provided on the periphery of the core metal electrode 14*a*** having an outer diameter of ϕ6 (mm) and serving as a conductive support member, whereby the outer diameter was set at ϕ11.5 (mm). In the eighth example, urethane rubber was used.

Next, an alumina sol solution was prepared, and the developing roller 14 was dipped in the alumina sol solution up to the rubber layer **14*b*1 to form the alumina surface layer 14*b*2** at 1.5 μm. The alumina sol solution used here was prepared by stirring and mixing together aluminum-sec-butoxide (Al(O-sec-Bu)3), which is an aluminum alkoxide, and isopropyl alcohol to a volume ratio of 1:9. Further, acetyl acetone was intermixed with the aluminum alkoxide as a stabilizer to obtain a mol ratio of 1, whereupon the resulting mixture was stirred for three hours at room temperature to prepare an aluminum sol liquid.

Furthermore, in the eighth example, the surface of the rubber layer **14*b*1 was subjected to UV irradiation before being dipped in order to improve the coating performance and the adhesiveness of the alumina sol solution. After forming the alumina surface layer 14*b*2, the developing roller 14 was dried for fifteen minutes at 200° C. The resistance of the developing roller 14** was $10^5\Omega$, and the Asker-C hardness was 45 degrees. The surface layer resistivity was $10^{10}$ Ωcm, and the rubber layer resistivity was $10^9$ Ωcm. Further, the surface layer hardness according to the nanoindentation method was 120 MPa.

In the present invention, an average value of the pore distribution of the alumina surface layer **14*b*2 is preferably no smaller than 0.1 nm and no larger than 500 nm. The average value of the pore distribution of the alumina surface layer 14*b*2 was measured using the Tristar 3000, manufactured by Micromeritics. When the average value of the pore distribution is smaller than 0.1 nm, the softness of the film decreases so that the alumina surface layer 14*b*2 cannot easily follow the deformation of the rubber layer 14*b*1**, and as a result, cracks are formed more quickly.

When the average value of the pore distribution is larger than 500 nm, on the other hand, the alumina surface layer **14*b*2 becomes brittle, and therefore becomes worn more quickly. As a result, an increase in the amount of fog caused by an increase in toner charge decay occurs due to cracks or wear. The average pore distribution in the eighth example is 10 nm, and therefore the alumina surface layer 14*b*2 exhibits superior softness. Hence, stable images can be obtained over time in both the first embodiment and the second embodiment. In particular, the alumina surface layer 14*b*2 is formed from aluminum alkoxide, which is an aluminum raw material, and therefore the evenness of the alumina surface layer 14*b*2 and the adhesiveness thereof to the rubber layer 14*b*1 are favorable. As a result, the alumina surface layer 14*b*2 can be prevented from cracking and peeling away from the rubber layer 14*b*1**, and therefore an improvement in durability is obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-235293, filed on Nov. 13, 2013, which is hereby incorporated by reference herein in its entirety.

What is claimed is:

1. A developer carrying member that is capable of carrying a developer on a surface thereof, and that supplies the developer carried on the surface to a surface of an image bearing member when a voltage is applied thereto, comprising:

an elastic layer; and a surface layer that covers the elastic layer, contains alumina, and has a higher volume resistivity than the elastic layer, wherein an Asker-C hardness is no lower than 45 degrees and no higher than 70 degrees, and a microhardness measured using a nanoindentation method is no lower than 50 MPa and no higher than 220 MPa.

2. The developer carrying member according to claim 1, wherein a volume resistance is greater than $2\times10^4\Omega$ and smaller than $5\times10^6\Omega$.

3. The developer carrying member according to claim 1, wherein a thickness of the surface layer is no smaller than 0.01 μm and no larger than 5.0 μm, and the volume resistivity of the surface layer is no smaller than $10^{10}$ Ωcm and no larger than $10^{14}$ Ωcm.

4. The developer carrying member according to claim 1, wherein a thickness of the surface layer is no smaller than 0.1 μm and no larger than 2.5 μm, and the volume resistivity of the surface layer is no smaller than $5\times10^{10}$ Ωcm and no larger than $5\times10^{13}$ Ωcm.

5. The developer carrying member according to claim 1, wherein an average diameter of a pore distribution of the surface layer is no smaller than 0.1 nm and no larger than 500 nm.

6. The developer carrying member according to claim 1, wherein the surface layer is formed using a colloidal alumina solution.

7. The developer carrying member according to claim 1, wherein the surface layer is formed by subjecting aluminum alkoxide to a hydrolysis process and a condensation process.

8. A developing assembly comprising:

a developer container housing a developer; and the developer carrying member according to claim 1.

9. A process cartridge that can be attached to a main body of an image forming apparatus detachably in order to perform an image formation process, comprising:

an image bearing member capable of bearing a developer image; and the developer carrying member according to claim 1, which forms the developer image by developing an electrostatic latent image on the image bearing member.

10. An image forming apparatus comprising:

an image bearing member capable of bearing a developer image;

the developer carrying member according to claim 1, which forms the developer image by developing an electrostatic latent image on the image bearing member; and applying means for applying a voltage to the developer carrying member.

* * * * *